United States Patent [19]

Knez

[11] Patent Number: 4,881,287

[45] Date of Patent: Nov. 21, 1989

[54] APPARATUS FOR TREATING ROUND OBJECTS

[76] Inventor: Jordan Knez, Industrivägen 21, S-Halmstad, Sweden

[21] Appl. No.: 163,942

[22] Filed: Mar. 3, 1988

[51] Int. Cl.[4] ..... A63B 47/04

[52] U.S. Cl. ..... 15/21 A; 15/3.13

[58] Field of Search ..... 15/21 A, 3.13, 3.14, 15/3.16, 97 R, 160

[56] References Cited

U.S. PATENT DOCUMENTS

| | | | |
|---|---|---|---|
| 409,754 | 8/1889 | Phelps | 15/3.16 |
| 1,058,461 | 4/1913 | Porter | 15/3.16 |
| 1,796,704 | 3/1931 | Day | 15/21 A |
| 3,120,669 | 2/1964 | Montuori | 15/21 A |
| 3,349,419 | 10/1967 | Kuhl | 15/3.13 |
| 3,400,416 | 9/1968 | Nicholson | 15/21 A |
| 3,654,655 | 4/1972 | Mitnick | 15/21 A |
| 3,981,039 | 9/1976 | Rumph | 15/21 A |
| 4,016,618 | 4/1977 | Kobayashi | 15/21 A |

*Primary Examiner*—Harvey C. Hornsby
*Assistant Examiner*—K. O'Leary
*Attorney, Agent, or Firm*—Beveridge, DeGrandi & Weilacher

[57] ABSTRACT

The disclosure relates to an apparatus for washing objects such as golf balls, the apparatus essentially comprising two disks (33,36) which are disposed in register and in spaced-apart relationship, the disks being provided, on their sides facing one another, with brush devices (34,37), the spacing between the bruch devices (34, 37) being less than the diameter of the objects, at least the one disk (36) being rotary and the objects being fed in between the disks (33,36) via a central aperture (35) in the one disk (33).

12 Claims, 1 Drawing Sheet

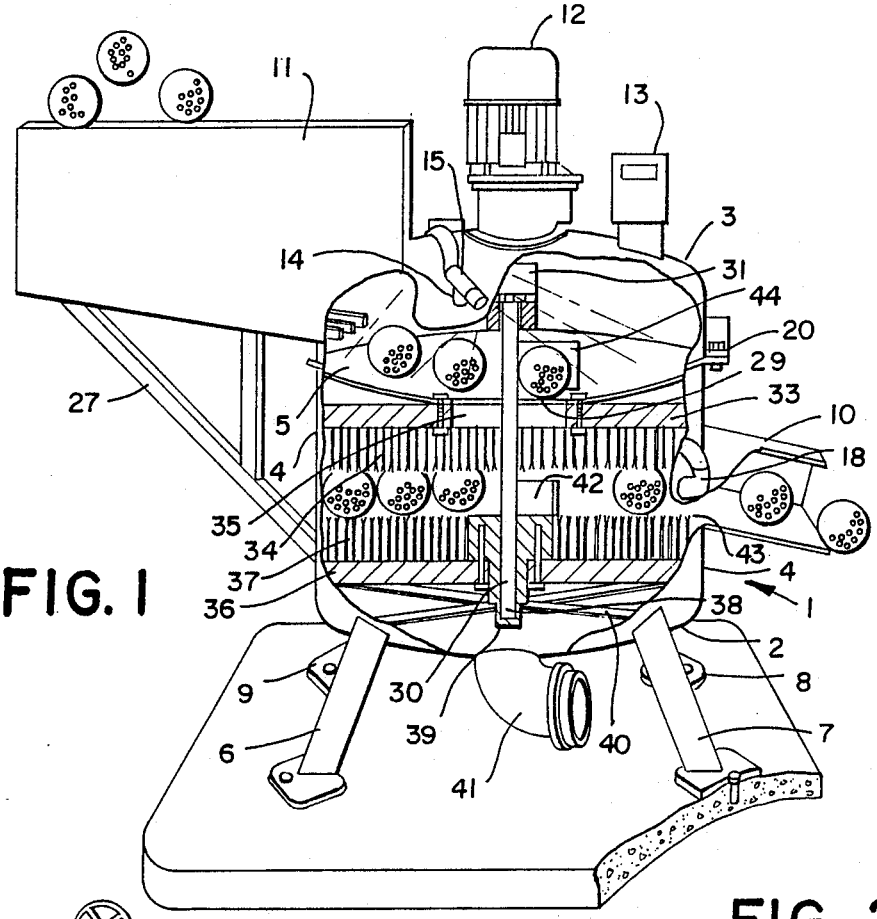
FIG. 1
FIG. 2
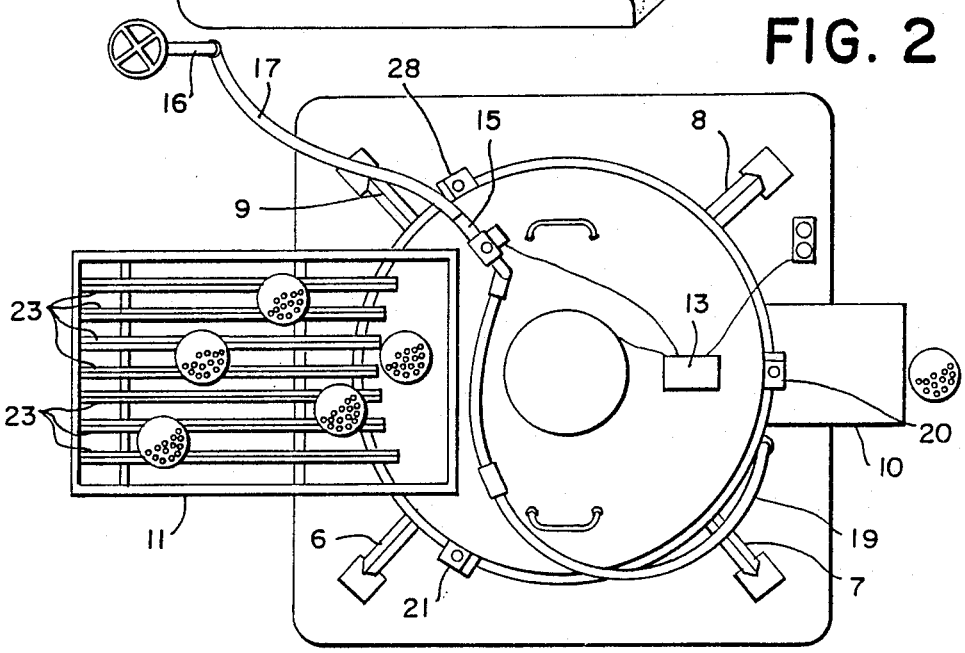

APPARATUS FOR TREATING ROUND OBJECTS

The present invention relates to an apparatus for treating substantially round objects, for example washing golf balls.

Prior art apparatuses for the cleaning (washing) of golf balls suffer from poor efficiency and insufficient capacity to meet the day's requirements at driving ranges, where thousands of golf balls may be driven-off per hour, and thereafter collected, either by means of collecting machines or by hand. In addition, the prior art apparatuses are of extremely complicated construction, which entails relatively poor dependability, with numerous and extensive repairs involved, as well as considerable costs both for manufacture and running of the machines. Thus, there is an urgent need in this art for a more efficient golf ball washing machine of such capacity that the day's - preferably also expected-needs may be met, since trends in this particular area are developing apace both nationally and internationally. Furthermore, it is of crucial importance that a novel machine be of extremely simple construction so as to attain a high degree of dependability from the point of view of efficient performance and, also all, from the point of view of operational reliability.

The task forming the basis of the present invention is to satisfy the above-outlined needs.

This task is achieved according to the present invention in that the apparatus disclosed by way of introduction is characterized by two disks disposed in register with one another and in spaced-apart relationship, the disks being provided on their sides facing one another with brush devices, the spacing between the brush devices being less than the diameter of the objects, at least one of the disks being rotary and the objects being fed in between the disks by the intermediary of the central aperture in this one disk.

The apparatus realised by the present invention is of extremely high capacity, in combination with efficient cleaning. Moreover, the apparatus according to the present invention is of extremely simple construction, which makes for a high degree of dependability and, thereby, consequentally great operational reliability.

The nature of the present invention and its aspects will be more readily understood from the following brief description of the accompanying drawings, and discussion relating thereto.

In the accompanying drawings:

FIG. 1 is a side elevation, partly in section, of one embodiment of the apparatus according to the present invention.

FIG. 2 is a top plan view of the apparatus of FIG. 1.

Referring to the drawings, the embodiment of the present invention shown therein displays a container 1 which is cylindrical and, at the bottom, has a cup-shaped lower portion or bottom 2 and, at the top, a substantially similar cup-shaped lid 3. A cylindrical wall 4 is disposed on the cup-shaped bottom 2 and extends up towards the lid 3. Between the lid 3 and the cylindrical wall 4, there is disposed a cup-shaped partition 5 of substantially the same configuration as the lid 3, the lid 3 and the partition 5 being turned to face one another, with the cup-shaped arching facing outwards. The cup-shaped partition 5 is placed in the cylndrical wall 4. The cup-shaped bottom portion 2 is provided with four legs 6, 7, 8 and 9 which are each provided with suitable feet.

The cylindrical wall 4 further displays a discharge funnel 10.

One side of the apparatus is provided with an infeed funnel 11. The lid 3 mounts a substantially centrally disposed motor 12 and control equipment 13 intended for the motor 12. In addition, the lid 13 carries a nozzle 14 which discharges in the inside of the lid 3. The lid 3 is provided with a coupling 15 for connection of a water hose, and a faucet or valve 16 which may be an electrically operated magnet valve which opens and closes for the water supply for example when the motor 12 is started and stopped, respectively. The nozzle 14 is coupled to the valve 16 by means of a suitable pipe 17. A further nozzle 18 is disposed on the cylindrical wall 4 and is connected to the nozzle 14 by the intermediary of a suitable pipe or hose 19. The pipes 17 and 19 may suitably be of plastic, but, naturally, may also be of other material types which may be deemed suitable in the context.

The lid 3 is provided with lugs 20 and 21 for cooperation with corresponding lugs on the partition 5. The lugs 20 and 21 are provided with through holes, like the corresponding lugs on the partition 5, for bolts. The lid 3 is further provided with a handle 22.

The bottom of the infeed funnel 11 displays a number of bars or rods 23 which are placed in such mutual spaced-apart relationship that a golf ball cannot pass between them. At the end of the infeed funnel most proximal the lid 3, the rods 23 may be terminated by two arcuately bent bands which are placed with spacing to fit on the edge of the partition 5. This edge is exposed by a recess in the lid 3. At the underside of the funnel 11, there is disposed a support 27 whose one end may be placed approximately centrally on the middle rod 23, while its opposing end rests on the cylindrical wall 4 or the bottom portion 2. That part of the support 27 which is located at the bottom portion 2 may very well be connected to the end of the middle rod 23 located most proximal the partition 5, which provision avoids point loading on the cylindrical wall 4 or the bottom portion 2. The rods 23 consist of square tubing which are oriented in such a manner that the rods 23 pairwise form rolling surfaces for the golf balls.

FIG. 2 further shows a third lug 28 which also has its counterpart on the lid 3. The partition 5 is centrally provided with an aperture 29, through which extends a shaft 30, the shaft being provided at the top with a coupling member 31 intended for cooperation with a corresponding coupling member on the output shaft (not shown) from the motor 12. A rubber transmission unit is appropriately disposed between the coupling members for imparting a certain gentle action to the coupling. On its lower side, the partition 5 carries a circular disk 33 which supports, on its side facing away from the partition 5, a brush 34. The disk 33 is provided with a central aperture 35 corresponding to the central apeture 29 in the partition 5.

The shaft 30 carries a further disk 36 which, on its upper face, supports a brush 37 of the same type as the brush 34 on the disk 33. The disks 33 and 36 are substantially of the same size and may appropriately consist of a suitable plastic material, like the brushes 34 and 37. The shaft 30 extends through the brush 37 and the disk 36, and terminates on the opposite side of the disk 36 in relation to the brush 37 in the form of a stub shaft 38. The stub shaft 38 is to be inserted in a bearing bushing 39 in a spider 40 which is fixed to the edges of the bottom portion 2. Centrally in the bottom portion 2, there is provided an outlet 41 for drainage of water and residues from the washing operation. A blade or vane 42 is fixedly disposed on the shaft 30 above the brush 37 and serves to move the objects out in a helical path to the edge of the disk 36 and the brush 37 where the objects in due course arrive at a discharge opening 43 which is provided with the discharge funnel 10 which may open above bucket, collection basket or the like.

The distance between the disks 33 and 36 has been selected such that the spacing between the brushes 34 and 37 will be less than the diameter of the object which is to be treated in the present case a golf ball. Experiments have shown that a suitable spacing between the tips of the brushes 34 and 37 is approximately 32–35 mm, given that the golf ball has a diameter of approximately 42 mm. Experiments have further shown that an appropriate speed for the shaft 30 is of the order of 40–60 rmp and, to prevent accumulation jamming of golf balls in the aperture 29, a blade or vane 44 is provided. The blade 44 is secured to the shaft 30 and is made of rubber or the like. The blade 44 will, as a result rotate with the shaft 30. Advantageously, the nozzle 18 disposed on the cylindrical wall 4 discharges in the space between the disks 33 and 36, whereby not only will the golf balls proper be sprayed, but the brush itself will also be cleaned of dirt removed from the golf balls.

Baskets containing golf balls from, for example, a range collecting machine, or ball harvester, may be emptied directly into the infeed funel 11, in which event large deposits of dirt will fall straight through the bottom of the infeed funnel 11 thanks to the provision of the rods 23. Naturally, the bottom of the infeed funnel 11 formed by the rods 23 slops in towards the opening 26 in the lid 3. Thus, the golf balls will roll in onto the partition 5 and down to the central aperture 29 in the partition 5 and further down through the central aperture 35 in the disk 33 where the golf balls, because of the presence of the blade or vane 42, are urged in between the brushes 34 and 37 on the disks 33 and 36. The golf balls on the partition 5 are sprayed via the nozzle 14, in the same manner as the golf balls between the brushes 34 and 37 are sprayed via the nozzle 18. It will be obvious to the skilled reader of this specification that a greater number of nozzles than that shown on the drawings may be provided, as well as nozzles solely intended for the supply of detergent or cleaning agent. Because of the rotation of the brush 37 and the disk 36, the golf balls will describe a helical path out towards the edge of the brush 37, finally arriving in the opening 43 and thence out into a collection basked or bucket via the channel or funnel 10. As was mentioned previously, accumulation jamming in the aperture 29 will be prevented by means of the blade 44. The result obtained from experiments has proved to the extraordinarily positive. It should further be observed that the outlet 41 in the bottom portion 2 may, naturally, be provided with a connection socket for a drainage pipe or the like which may be connected to a drain system which may possibly lead to some type of waste treatment plant. In those cases when no detergent or cleaning agent is used, the wastewater may be freely discharged without special provisions.

It is also possible, according to the present invention, to cause both of the disks 33 and 36 to rotate. In such an event, it is appropriate to cause the disks 33 and 36 to rotate in opposite directions. Furthermore, the motor 12 may be provided with a speed governor for the optional adjustment or optional selection - and, naturally, also variation of the speed of rotation of the disk 36 or of the disks 33 and 36.

The present invention should not be considered as restricted to that described above and shown on the drawings, many modifications being conceivable without departing from the spirit and scope of the appended claims.

I claim:

1. An apparatus for the treatment of round objects, for example the washing of golf balls, comprising two circular disks disposed in register and in spaced-apart relationship, at least one of the disks being provided with brush devices on its side facing the other disc the space between the disks being less than the diameter of the objects, one disk being rotary and one disk being fixed, a central aperture in the fixed disk for feeding objects into the space between the disks, said disks being disposed in a circular container having a cup-shaped bottom portion and a cup-shaped partition with a central aperture corresponding to the central aperture in the fixed disk, said fixed disk being fixedly mounted on the underside of the partition.

2. The apparatus as claimed in claim 1, wherein the disks are arranged in superposed relationship, with the rotary disk being undermost, and the central aperture being located in the fixed disk.

3. The apparatus as claimed in claim 2, wherein the rotary disk is fixedly mounted on a shaft which extends through the central aperture.

4. The apparatus as claimed in claim 3, wherein the shaft is coupled to a motor for rotation thereof, the rotary disk being fixedly mounted on said shaft and provided with a brush device.

5. The apparatus as claimed in claim 3, wherein the shaft is, in the region between the disks, provided with means for moving the objects away from the central region such that the objects fundamentally follow a helical path from the central region out towards the edge of the lower disk and further out through a discharge aperture.

6. The apparatus as claimed in claim 1 wherein nozzles are provided for spraying the objects with liquid.

7. The apparatus as claimed in claim 6 wherein the container is provided with a substantially cup-shaped lid which carries the motor for driving the shaft, and valve means for controlling liquid supplied.

8. The apparatus as claimed in claim 1, wherein the brush devices cover the disk surfaces facing one another.

9. The apparatus as claimed in claim 1, characterised in that the disks (33,36) are circular and are disposed in a circular container (1) which has a cup-shaped bottom portion (2) and a cup-shaped partition (5) with a central aperture (29) corresponding to the central aperture (35) in the fixed disk (33), which is fixedly mounted on the underside of the partition (5).

10. The apparatus as claimed in claim 1, wherein the partition forms an infeed funnel for the objects.

11. An apparatus for the treatment of round objects, for example the washing of golf balls, comprising an upper disk and a lower disk in register and in spaced apart superposed relationship, said upper disk being fixed, at least one of said disks being provided with brush devices which face the other said disk, said disks being spaced apart a distance which is less than the diameter of objects to be treated, a central aperture arranged to feed objects in between the disks, a motor having a shaft which extends through the central aperture and is fixed to the lower disk for rotating the lower disk, said shaft having, between the disks, means for moving objects outwardly in a generally helical path from a central area toward an outer edge of the lower disk, and a discharge aperture for discharging objects from the apparatus.

12. The apparatus as claimed in claim 11 including nozzle means for spraying the objects with a liquid.

* * * * *